United States Patent [19]

Mamke

[11] Patent Number: 4,928,762

[45] Date of Patent: May 29, 1990

[54] RETRIEVABLE BRIDGE PLUG AND PACKER

[75] Inventor: Kevin R. Mamke, Lewisville, Tex.

[73] Assignee: Halliburton Company, Duncan, Okla.

[21] Appl. No.: 310,276

[22] Filed: Feb. 13, 1989

[51] Int. Cl.[5] ..... E21B 33/12

[52] U.S. Cl. ..... 166/192; 166/119; 166/237

[58] Field of Search ..... 166/119, 123, 133, 134, 166/135, 138, 139, 140, 210, 216, 217, 237, 240, 192, 179

[56] References Cited

U.S. PATENT DOCUMENTS

| | | | |
|---|---|---|---|
| Re. 28,641 | 12/1975 | Chenoweth | 166/139 |
| 3,289,766 | 12/1966 | Bigelow | 166/139 |
| 4,149,594 | 4/1979 | Evans | 166/134 |
| 4,427,063 | 1/1984 | Skinner | 166/134 |
| 4,567,944 | 2/1986 | Zunkel et al. | 166/120 |
| 4,569,396 | 2/1986 | Brisco | 166/305.1 |
| 4,627,491 | 12/1986 | Zunkel | 166/126 |
| 4,664,188 | 5/1987 | Zunkel et al. | 166/134 |

OTHER PUBLICATIONS

Halliburton Sales & Service Catalog No. 43, pp. 2559–2560 and 2563–2565.

*Primary Examiner*—Stephen J. Novosad
*Assistant Examiner*—Terry Lee Melius
*Attorney, Agent, or Firm*—James R. Duzan; Neal R. Kennedy

[57] ABSTRACT

A retrievable bridge plug and packer apparatus. The tool includes a packer settable by right-hand rotation and vertical manipulation of the tool string and a bridge plug also settable by right-hand rotation and vertical manipulation of the tool string. A disabling tool is provided to disable the packer during setting of the bridge plug so that the packer is not prematurely set. After setting of the bridge plug below the formation, the packer and disabling tool may be disengaged from the bridge plug. At this point, the disabling tool is disengaged so that the packer may be set above the formation. The packer is unset by pulling on the tool string, and the packer and disabling tool may be reconnected to the bridge plug. Again lifting on the tool string unsets the bridge plug so that the apparatus may be retrieved or reused. A method of treating a well formation is also disclosed.

16 Claims, 7 Drawing Sheets

RETRIEVABLE BRIDGE PLUG AND PACKER

BACKGROUND OF THE INVENTION

1. Field Of The Invention

This invention relates to retrievable bridge plugs and packers used to isolate sections of a well formation, and more particularly, to such a tool including a packer disabling tool wherein the packer and bridge plug are set using only right-hand torque and vertical pipe manipulation.

2. Description Of The Prior Art

While stimulating wells, it is desirable to isolate some sections of the formation from the treatment. This has been done in the past by such means as using drillable bridge plugs or chemical blocks. These have problems in that the bridge plug must be drilled out and may not be reused. Also, chemical blocks must be removed.

Another method of isolating formation sections is to use a retrievable bridge plug and packer combination tool. With such a tool, the bridge plug portion is set below the formation using left-hand torque, and the packer portion is then detached from the bridge plug and set above the formation using right-hand torque. A typical bridge plug used in such operations is the Halliburton Model 3L bridge plug disclosed in Halliburton Services Sales & Service Catalog No. 43, pages 2559–2560 and in U.S. Pat. No. 4,427,063. The packer is either the Halliburton RTTS or Champ® packer, such as shown in the above-referenced sales and service catalog, pages 2563–2565. This general type of packer is shown in U.S. Pat. No. 4,567,944.

In using such tools in horizontal or highly deviated wells, the extra friction due to the dragging of the tool in the hole can sometimes result in undesirable disconnection of tool string elements during the left-hand rotation used in setting the bridge plug. Accordingly, it is desirable to have a tool with a separable bridge plug and packer which can be set without using left-hand torque.

The retrievable bridge plug and packer of the present invention solves this problem by providing a tool with a retrievable packer and a retrievable bridge plug, both of which are set with right-hand torque and vertical pipe manipulation. A packer disabling tool is used to prevent setting of the packer while the bridge plug is being set. The packer itself is the same as the RTTS or Champ® III packer described above, and the bridge plug in the present invention is basically the same as the Model 3L bridge plug described above except that it has been modified to be set with right-hand torque rather than left-hand torque.

SUMMARY OF THE INVENTION

The retrievable bridge plug and packer of the present invention is adapted for use in a well bore adjacent to a formation to be treated. The apparatus comprises plug means for sealingly engaging the well bore when in a set position, plug setting means for setting the plug means by applying torque in one direction to a portion thereof, packer means for sealingly engaging the well bore when in a set position at a location spaced from the plug means, and packer setting means for setting the plug means by applying torque in the same one direction to a portion thereof as was applied to the plug setting means. The apparatus preferably further comprises disabling means for disabling the packer setting means while the plug means is being set. A means is also provided for disconnecting the packer means from the plug means after setting of the plug means.

The disabling means comprises upper and lower engaging means for preventing relative rotation therebetween when in a packer disabling position, and the upper and lower engaging means are spaced from one another when in a packer setting position. In one preferred embodiment, the upper engaging means is characterized by an upper disabling sleeve connected to the packer means and having upper disabling teeth thereon, and the lower engaging means is characterized by a lower disabling sleeve connected to the packer means and having lower disabling teeth thereon. The lower disabling teeth are engaged with the upper disabling teeth when in the packer disabling position, and the teeth are spaced from one another when in the packer setting position.

The packer means comprises mandrel means for extending from the packer means and into the upper and lower engaging means, and the apparatus further comprises means for preventing relative rotation between the mandrel means and the lower engaging means. In the preferred embodiment, the means for preventing relative rotation comprises one of the mandrel means and lower engaging means defining a slot therein, and the other of the mandrel means and lower engaging means having a pin extending therefrom and into the slot.

J-slot means are provided on one of the mandrel means and lower engaging means, and J-slot engaging means are provided on the other of the mandrel means and lower engaging means for engaging the J-slot means. This engagement of the J-slot engaging means with the J-slot means results in the lower engaging means and upper engaging means being relatively moved between the packer disabling position and the packer setting position during manipulation of the tool string to which the apparatus is attached.

Drag means are provided on the upper and lower engaging means for frictionally engaging the well bore and holding the upper and lower engaging means relatively stationary with respect to the packer means during at least a portion of the operation of the apparatus.

Stated in another way, the apparatus includes a downhole tool comprising a packer attachable to a tool string and including packer setting means for setting the packer in a well bore, a bridge plug connected to the packer and including plug setting means for setting the plug in the well bore, and means for disabling the packer setting means during setting of the plug and re-engaging the packer setting means for subsequent setting of the packer. The packer setting means and the plug setting means are actuated at least in part in response to rotation of the tool string in a single direction. Normally, this single direction is to the right when viewed from the top of the well bore.

The invention also provides a method of treating a well formation comprising the steps of positioning a tool on a tool string in a well bore, said tool string comprising a bridge plug and a packer above the bridge plug; setting the bridge plug into sealing engagement with the well bore below the formation by applying torque in a single direction to the tool string; during the step of setting the bridge plug, disabling the packer so that the packer cannot be prematurely set; after setting of the bridge plug, re-enabling the packer so that it can be set; and setting the packer into sealing engagement with the well bore above the bridge plug by applying torque to the tool string in the same direction used for setting the bridge plug. The method further comprises the step of disconnecting the packer from the bridge plug after setting of the bridge plug. The method may also comprise retrieving the tool which comprises the steps of unsetting the packer from the well bore, reconnecting the packer to the bridge plug, and unsetting the bridge plug from the well bore.

It is an important object of the present invention to provide a retrievable bridge plug and packer apparatus for use in sealing a well bore above and below a formation to be treated.

It is another object of the invention to provide a tool having a packer and a bridge plug, both of which are set by rotating the tool string in the same direction.

An additional object of the invention is to provide a packer and bridge plug tool set without left-hand rotation for use in horizontal or deviated wells.

It is a further object of the invention to provide a retrievable bridge plug and packer apparatus in which setting means for the packer is disabled during setting of the bridge plug and re-enabled after setting of the bridge plug so that the packer may be subsequently set.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
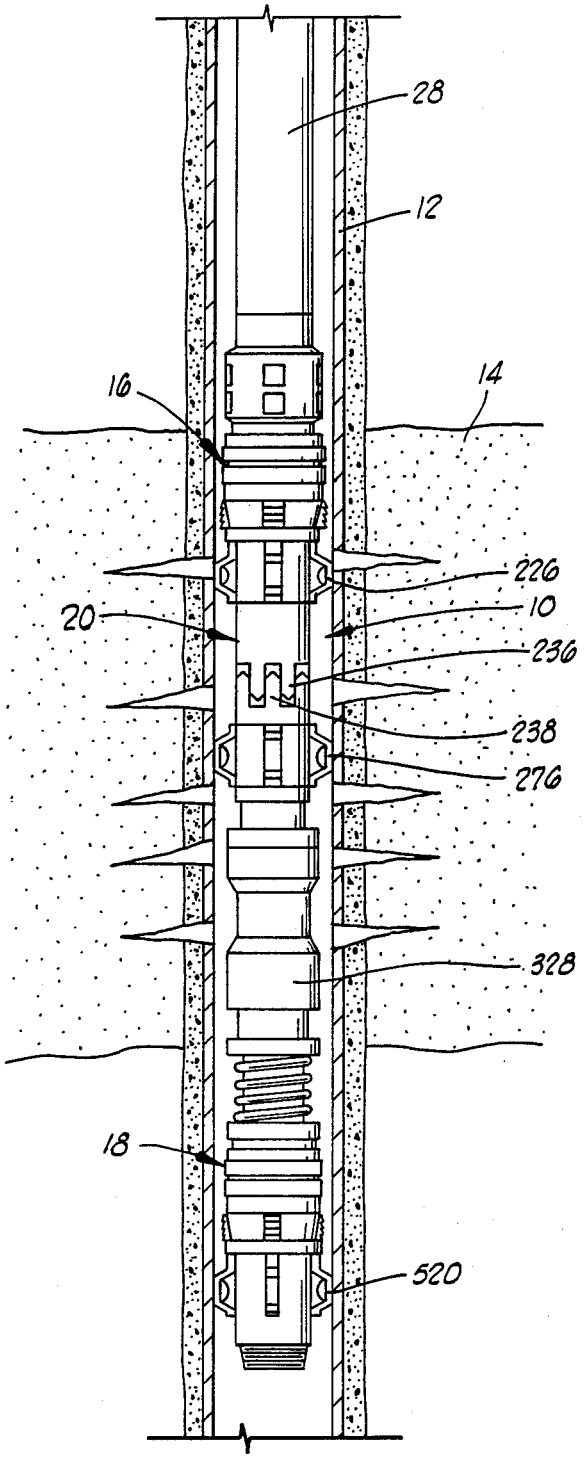
FIG. 1 is a schematic view of the retrievable bridge plug and packer tool of the present invention shown as it is lowered into a well bore adjacent to a formation.

Referring now to the drawings, and more particularly to FIG. 1, the retrievable bridge plug and packer tool of the present invention is shown and generally designated by the numeral 10. FIG. 1 illustrates tool 10 as it is run into casing 12 of a well bore adjacent to a formation 14.

Generally apparatus 10 comprises a packer means 16 for sealing above formation 14, a plug means 18 for sealing below formation 14, and a disabling means for disabling the setting of packer means 16 while plug means 18 is being set.

Figure 2:
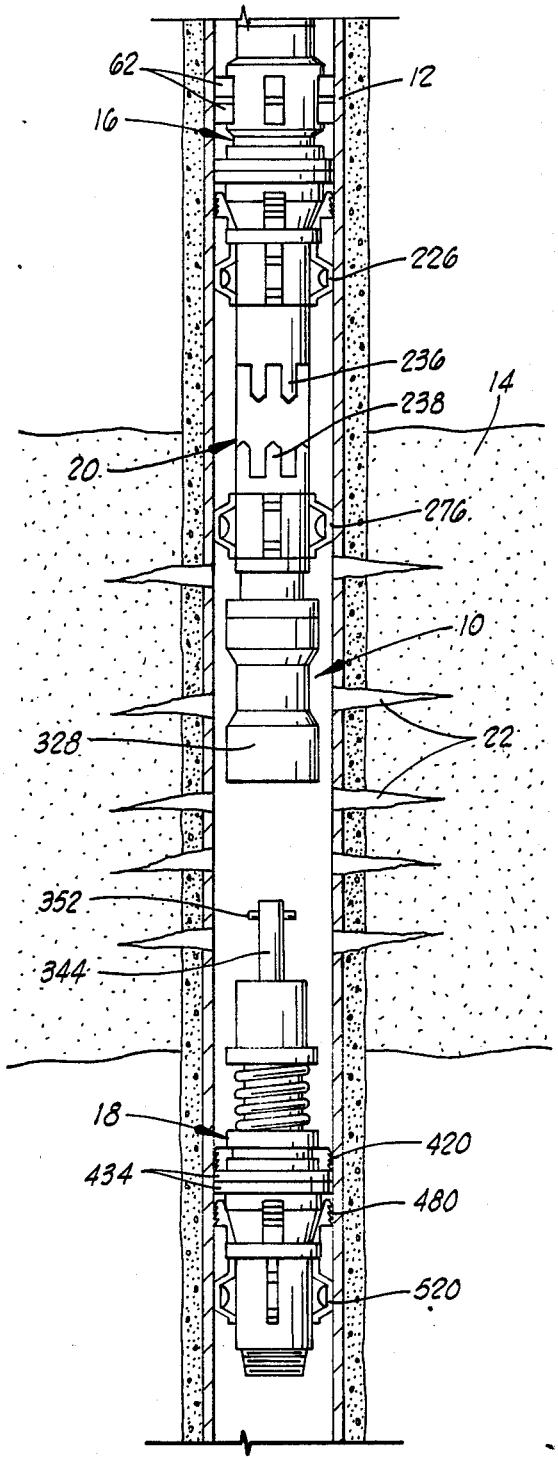
FIG. 2 illustrates the tool with the bridge plug set below the formation and the packer disconnected from the bridge plug and set above the formation.

FIG. 2 illustrates apparatus 10 in the set position in which plug means 18 is set in sealing engagement with well casing 12 below formation 14. Packer means 16 and disabling means 20 are disconnected from plug means 18 with packer means 16 set above into sealing engagement with casing 12 above formation 14. In this position, fluid may be flowed into and out of formation 14 through perforations 22 in a manner known in the art. The setting and other operation of tool 10 will be discussed in more detail herein.

Referring now to FIGS. 3A–3H, the details of retrievable bridge plug and packer 10 will be discussed. In FIGS. 3A–3H, packer means 16 is characterized by a retrievable packer 16 known in the art. Specifically, the Halliburton Champ® III packer is illustrated.

At the upper end of packer 16 is a top adapter 24 with a threaded inner surface 26 adapted for connection to a tool string 28. Top adapter 24 is connected to an upper packer mandrel 30 at threaded connection 32. A sealing means, such as O-ring 34, provides sealing engagement between top adapter 24 and upper packer mandrel 30.

Upper packer mandrel 30 has a first outside diameter 36 and a slightly smaller second outside diameter 38 therebelow. Upper packer mandrel 30 also has another outside surface 40 which is splined and is larger than second outside diameter 38 such that an upwardly facing shoulder 42 is defined therebetween. Below splined surface 40 is a downwardly facing shoulder 43 and a smaller third outside diameter 44. The lower end of upper packer mandrel 30 is connected to a coupling 46 at threaded connection 48.

Disposed around upper packer mandrel 30 is a hydraulic slip housing 50. Hydraulic slip housing 50 has a first bore 52 in close, spaced relationship to first outside diameter 36 of upper packer mandrel 30. The sealing means, such as O-rings 54, provide sliding, sealing engagement between upper packer mandrel 30 and hydraulic slip housing 50.

Hydraulic slip housing 50 defines a plurality of transverse openings 56 therethrough which open on the radially inward side into a second bore 58. It will be seen that second bore 58 of hydraulic slip housing 50 is spaced radially outwardly from second outside diameter 38 of upper packer mandrel 30 such that an annular gap 60 is defined therebetween. It will be seen by those skilled in the art that transverse openings 56 in hydraulic slip housing 50 are in communication with gap 60.

Disposed in each transverse opening 56 is a hydraulic slip 62. A seal 64 is provided between each hydraulic slip 62 in the corresponding opening 56.

Hydraulic slips 62 are retained in openings 56 by a hold-down strip 66. Hold-down strip 66 is attached to hydraulic slip housing 50 by a plurality of screws 68.

In a manner known in the art, hydraulic slips 62 are adapted to move radially outwardly when pressurized such that a portion thereof extends beyond hold-down strip 66 for gripping engagement with well casing 12. In the run-in position shown in FIG. 3A, hydraulic slips 62 are biased radially inwardly against second outside diameter 38 of upper packer mandrel 30 by a plurality of springs 70.

Hydraulic slip housing 50 has a third, splined bore 72 which has a downwardly facing shoulder 73 at the upper end thereof. Splined bore 72 is sized such that an annular gap 74 is defined between slip housing 50 and upper packer mandrel 30. Splined bore 72 in slip housing 50 is engaged by splined surface 40 on upper packer mandrel 30 so that relative rotation therebetween is prevented.

The lower end of coupling 46 is attached to lower packer mandrel 76 at threaded connection 78.

Connector 46 defines an annular volume 80 therein adjacent to first outside diameter 82 of lower packer mandrel 76. Coupling 46 also defines a longitudinally extending passageway 84 which provides communication between annular volume 80 and annular gap 74.

The lower end of hydraulic slip housing 50 is attached to a ported housing 86 at threaded connection 88. Ported housing 86 defines a first bore 90 therein, and a sealing means, such as O-ring 92, provides sealing engagement between hydraulic slip housing 50 and first bore 90 of ported housing 86.

Connector 46 has an outer surface 94 with an upwardly facing annular shoulder 96 at the lower end thereof.

A generally annular seal gland 98 is disposed between coupling 46 and ported housing 86. It will be seen that the upper end of seal gland 98 is adjacent to lower end 100 of hydraulic slip housing 50, and the lower end of seal gland 98 is adjacent to shoulder 96 on coupling 46. An outer sealing means, such as a plurality of seals 102, and an inner sealing means, such as a plurality of seals 104, provide sealing engagement between seal gland 98 and first bore 90 of ported housing 86 and outside surface 94 of coupling 46, respectively.

Figure 3A:
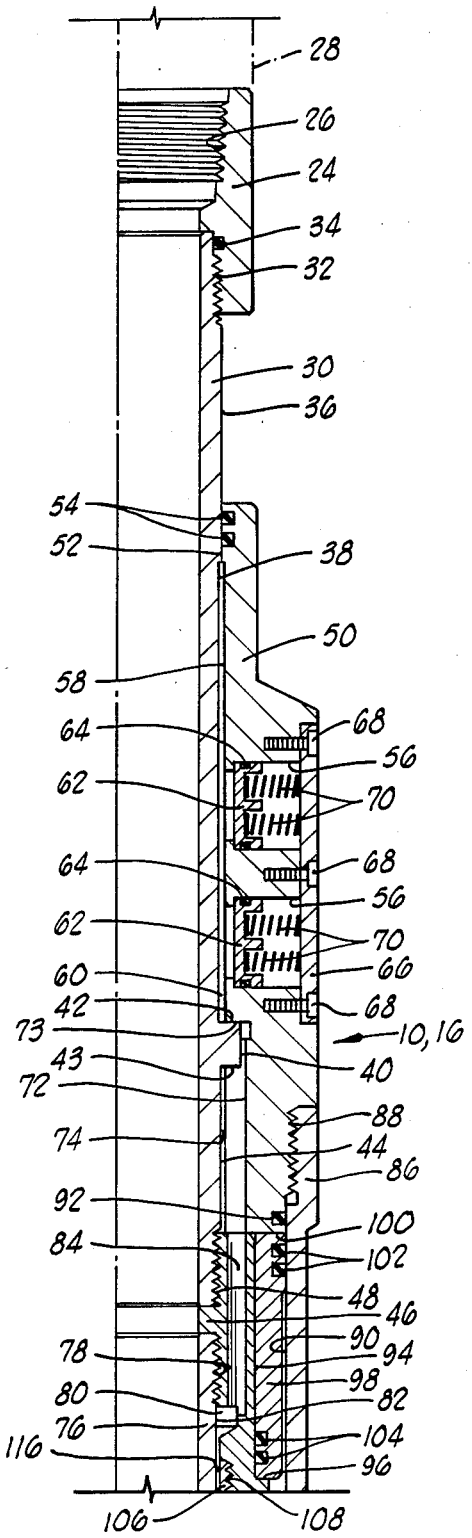
FIGS. 3A–3H show a longitudinal cross section of the present invention.
Figure 3B:
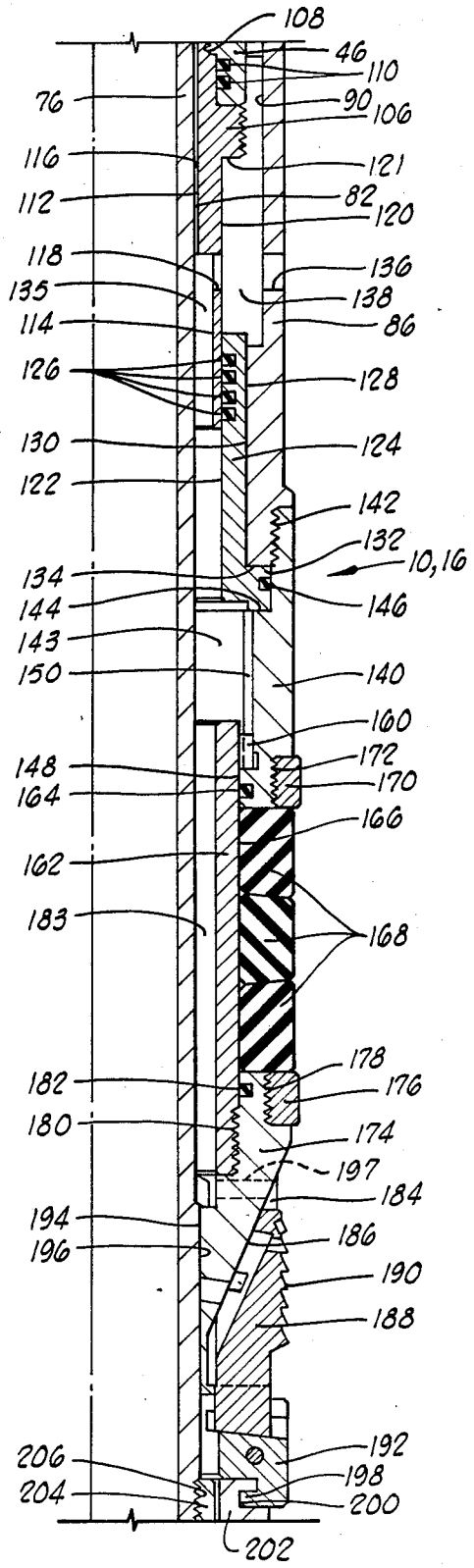

Referring now also to FIG. 3B, the lower end of coupling 46 is attached to an inner sleeve 106 at threaded connection 108. Sealing means, such as O-rings 110, provide sealing engagement between coupling 46 and inner sleeve 106.

Inner sleeve 106 defines a first bore 112 and a larger second bore 114 therethrough. First bore 112 is sized such that an annular gap 116 is defined between first bore 112 and first outside diameter 82 of lower packer mandrel 76. A transverse bypass port 118 is defined through inner sleeve 106 near the upper end of first bore 114.

Inner sleeve 106 has an outer surface 120 with a downwardly facing shoulder 121 at the upper end thereof. Outer surface 120 extends into a bore 122 of an outer sleeve 124. Sealing means, such as seals 126, provide sealing engagement between inner sleeve 106 and outer sleeve 124.

Outer sleeve 124 has an outer surface 128 which fits within a second bore 130 of ported housing 86. A flanged lower end 132 of outer sleeve 124 is positioned adjacent to lower end 134 of ported housing 86.

Inner and outer sleeves 106 and 124 form an annular volume 135 with lower packer mandrel 76 in communication with bypass port 118.

Ported housing 86 defines at least one transverse port 136 therethrough. An annular volume 138 is formed between inner sleeve 106 and first bore 90 of ported housing 86. It will thus be seen that port 136 in ported housing 86 are in communication with bypass port 118 in inner sleeve 106.

The lower end of ported housing 86 is attached to upper packing shoe support 140 of threaded connection 142. An annular volume 143 is defined between upper packing shoe support 140 and lower packer mandrel 76 and is in communication with annular volume 135. Upper packing shoe support 140 has an upwardly facing annular shoulder 144 positioned adjacent to lower end 132 of outer sleeve 124. A sealing means, such as O-ring 146, provides sealing engagement between outer sleeve 124 and upper packer shoe support 140.

Shoe support 140 defines a bore 148 in the lower end thereof with a longitudinal slot 150 in the bore. Engaging slot 150 is an outwardly extending lug of a packing element mandrel 162. A sealing means, such as O-ring 164, provides sealing engagement between shoe support 140 and outer surface 166 of element mandrel 162.

A plurality of elastomeric packing elements 168 are disposed on outer surface 166 of element mandrel 162. The upper packing element 168 is engaged by upper packing shoe support 140 and upper packing shoe 170 which is attached to upper packing shoe support 140 at threaded connection 172. The lower packing element 168 engages slip body 174 and lower packing shoe 176 which is attached to slip body 174 at threaded connection 178. The lower end of element mandrel 162 is connected to slip body 174 at threaded connection 180. A sealing means, such as O-ring 182, provides sealing engagement between slip body 174 and outer surface 166 of element mandrel 162.

Element mandrel 162 and lower packer mandrel 76 define an annular volume 183 therebetween which is in communication with annular volume 143.

Slip body 174 defines a plurality of wedge-shaped recesses 184 having a downwardly facing wedge-shaped ramp 186 therein. A slip 188 is disposed in each recess 184 and adapted to slide along ramp 186 in a manner known in the art when actuated. A plurality of teeth 190 are formed on the outer surface of each slip 188 and are adapted for grippingly engaging well casing 12. Slips 188 are loosely retained in place by a slip collar 192.

Slip body 174 has a bore 194 therein which is adapted for close, sliding relationship with second outside diameter 196 of lower packer mandrel 76.

Slip body 174 has a port 197 therethrough which is in communication with annular volume 183. It will be seen that port 197, annular volume 183, annular volume 143, annular volume 135, bypass port 118, annular volume 138 and port 136 thus form a bypass passageway around packer elements 168. This reduces fluid resistance as tool 10 is lowered into the well bore in a manner known in the art.

Slip collar 192 has an inwardly directed flange 198 which engages a groove 200 in the upper end of an upper engaging means characterized by an upper or first drag block sleeve 202 also referred to as upper disabling sleeve 202.

Figure 3C:
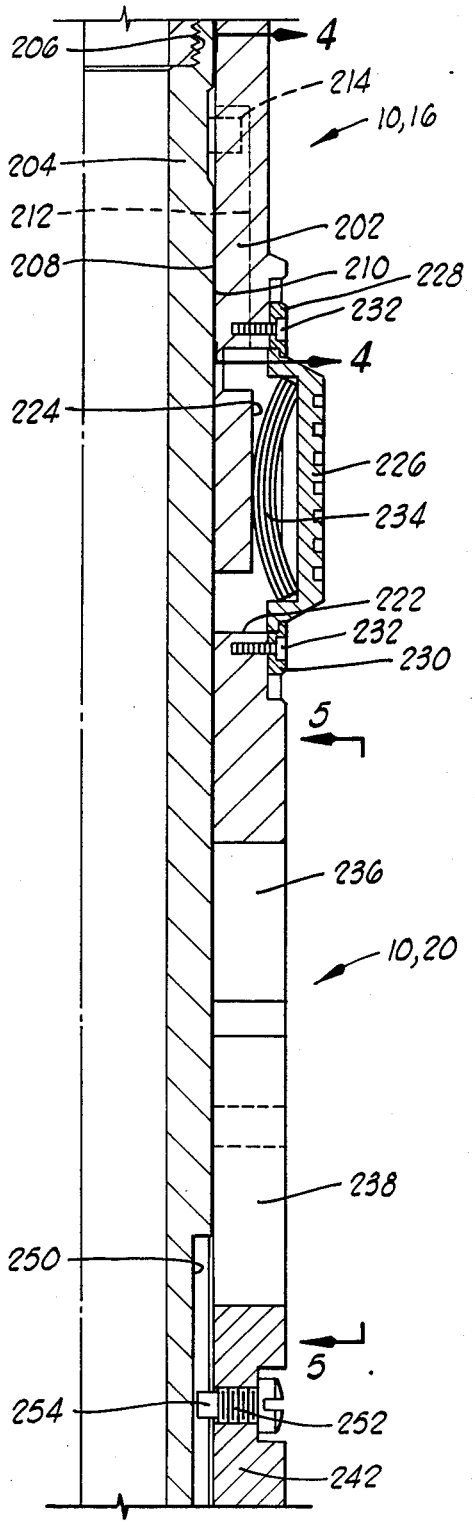

Referring now also to FIG. 3C, the lower end of lower packer mandrel 76 is connected to an upper disabling mandrel 204 at threaded connection 206.

Figure 4:
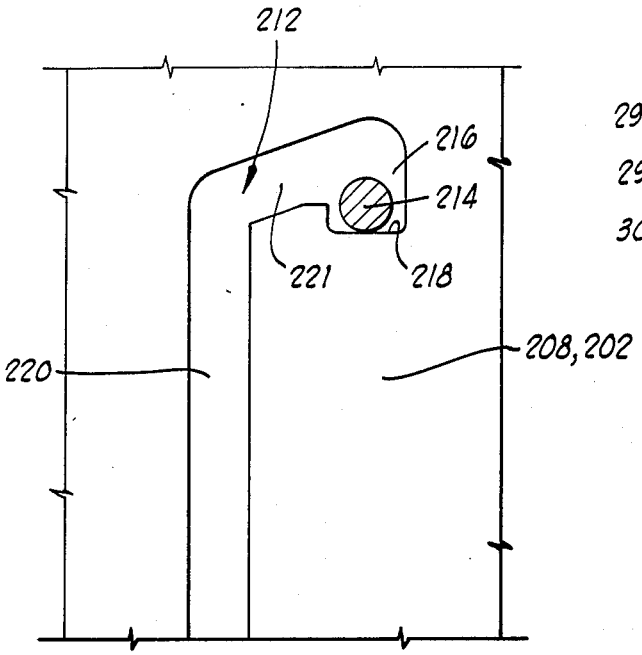
FIG. 4 shows a J-slot view taken along lines 4—4 in FIG. 3C.

Upper drag block sleeve 202 has a bore 208 therein which is adapted to slidably receive outer surface 210 of upper disabling mandrel 204. Referring also to FIG. 4, a J-slot 212 is defined in bore 208 of upper drag block sleeve 202. A lug 214 extends radially outwardly from upper disabling mandrel 204 into and engaging J-slot 212. J-slot 212 has a short leg 216 having a lower end 218 and is connected to a longer downwardly extending leg 220 by a transition portion 221.

Below J-slot 212, upper drag block sleeve 202 defines a plurality of transverse drag block openings 222 therein. A cylindrical portion 224 is aligned with openings 222 and faces radially outwardly. Disposed in each drag block opening 222 is a drag block 226. Each drag block 226 is retained in the corresponding drag block opening 222 by upper and lower drag block retainers 228 and 230 which are attached to upper drag block sleeve 202 by screws 232. A drag block spring 234 bears against cylindrical portion 224 of upper drag block sleeve 202 and biases the corresponding drag block 226 radially outwardly as shown in FIG. 3C.

Figure 5:
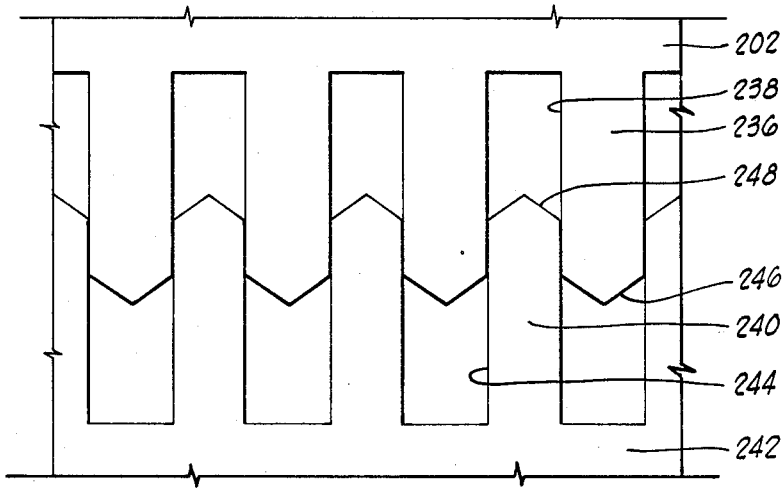
FIG. 5 is an elevational view of the fingers in the packer disabling section taken along lines 5—5 in FIG. 3C.

Referring now also to FIG. 5, the lower end of upper drag block sleeve 202 defines a plurality of downwardly extending upper disabling teeth 236. It will be seen that a gap 238 is defined between each disabling tooth 236. Upper disabling teeth 236 are engaged with a plurality of upwardly extending lower disabling teeth 240 on the upper end of a lower engaging means characterized by a lower or second disabling sleeve 242. Lower disabling teeth 240 are spaced such that a gap 244 is defined therebetween. When so engaged, upper disabling teeth 236 extend into gaps 244, and lower disabling teeth 240 extend into gaps 238. Upper disabling teeth 236 have a pointed lower end 246, and lower disabling teeth 240 have a pointed upper end 248.

Figure 3D:
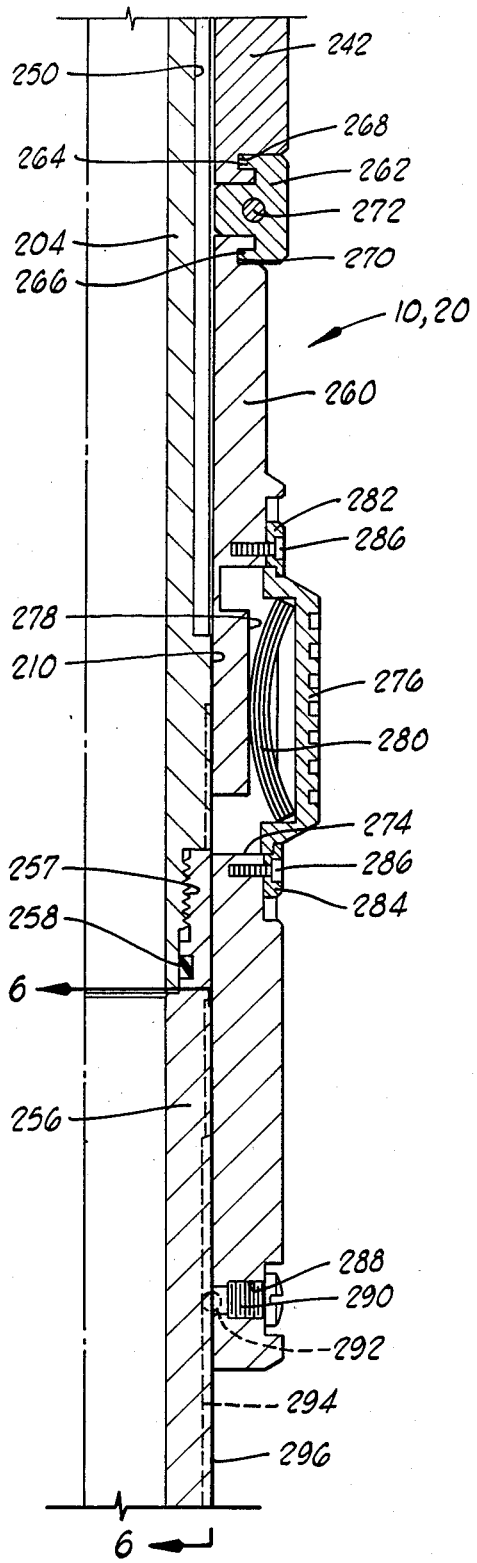

Referring now to FIGS. 3C and 3D, upper disabling mandrel 204 has a longitudinally extending slot 250 formed in outer surface 210 thereof. A screw 252 is engaged with lower disabling sleeve 242 and has a radially inner end or pin portion 254 which engages slot 250. It will be seen by those skilled in the art that relative longitudinal movement is possible between lower disabling sleeve 242 and upper disabling mandrel 204, but relative rotation therebetween is prevented by the engagement of pin 254 of screw 252 with slot 250.

Referring now to FIG. 3D, the lower end of upper disabling mandrel 204 is connected to a lower disabling mandrel 256 at threaded connection 257. A sealing means, such as O-ring 258, provides sealing engagement between upper and lower disabling mandrels 204 and 256.

The lower end of lower disabling sleeve 242 is attached to the upper end of a lower drag block sleeve 260 by a sleeve connector 262. Sleeve connector 262 has upper and lower inwardly directed flanges 264 and 266 which engage grooves 268 and 270 in lower disabling sleeve 242 and lower drag block sleeve 260, respectively. Sleeve connector 262 is held in place by a fastener 272 and is adapted to allow slight relative movement between disabling sleeve 242 and lower drag block sleeve 260.

Lower drag block sleeve 260 defines a plurality of transverse drag block openings 274 therethrough which are substantially identical to drag block openings 222 in upper drag block sleeve 202. Similar to the upper drag block arrangement, each drag block opening 274 has a drag block 276 therein which is biased outwardly from cylindrical portion 278 of lower drag block sleeve 260 by springs 280. Upper and lower drag block retainers 282 and 284 are attached to lower drag block sleeve 260 by screws 286 and retain drag blocks 276 in drag block openings 274.

Figure 3E:
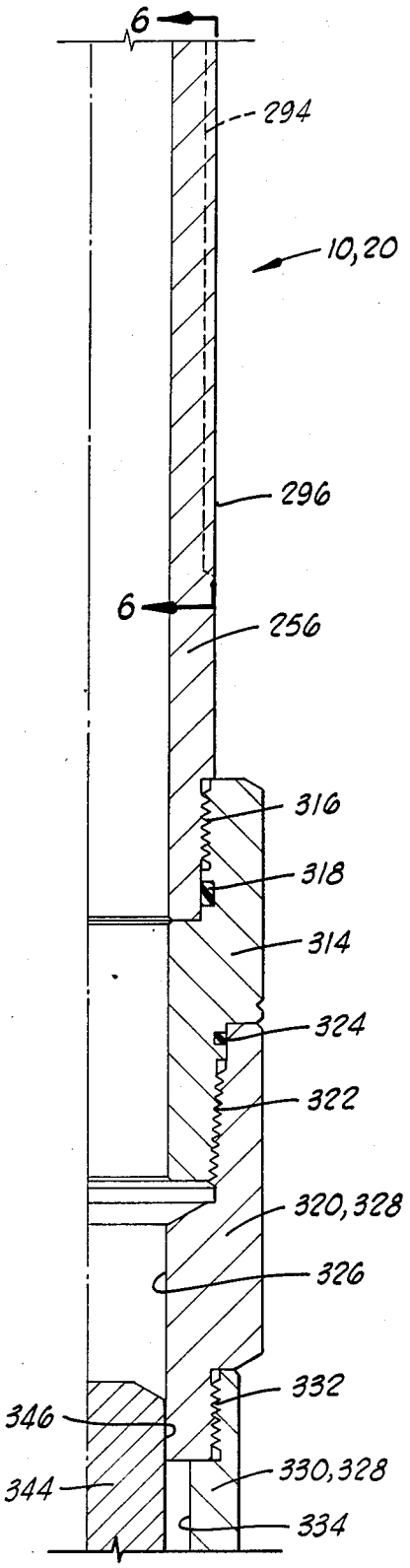

At the lower end of lower drag block sleeve 260 is a transverse threaded opening 288 in which is threadingly received a bearing retainer 290. Bearing retainer 290 locates and retains a ball bearing 292 which is rollingly received in a J-slot groove 294 formed in outer surface 296 of lower disabling mandrel 256, as seen in FIGS. 3D and 3E. A plurality of ball bearings 292 may actually engage J-slot groove 294 as desired. However, for the purposes of this disclosure, only one such ball bearing is shown and discussed.

Figure 6:
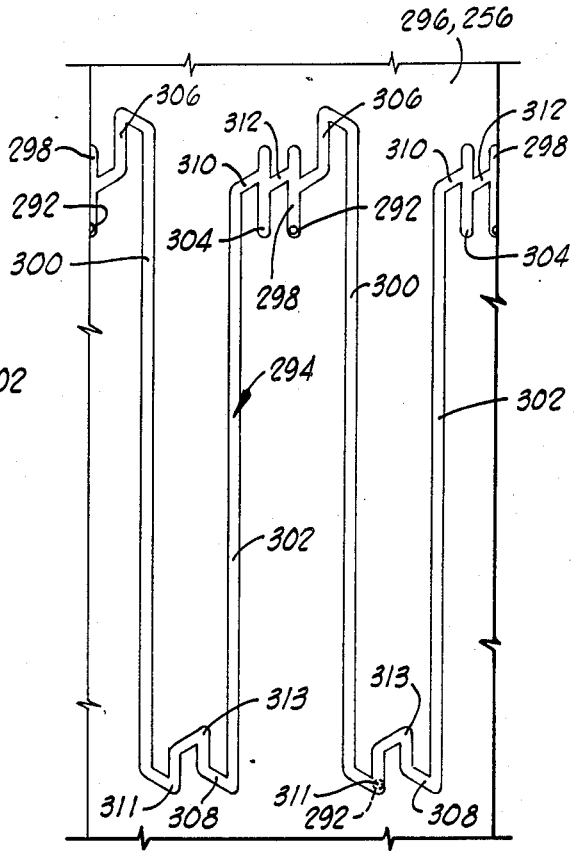
FIG 6 is a J-slot view taken along lines 6—6 in FIGS. 3D and 3E.

Referring now to FIG. 6, J-slot groove 294 forms a repeating pattern around lower disabling mandrel 256. The pattern comprises a first vertical portion 298, a longer second vertical portion 300, a third vertical portion 302 and a short fourth vertical portion 304. First and second vertical portions 298 and 300 are interconnected by a first transition portion 306, second and third vertical portions 300 and 302 are interconnected by a second transition portion 308, third and fourth vertical portions 302 and 304 are interconnected by a third transition portion 310, and fourth and first vertical portions 304 and 298 are interconnected by a fourth transition portion 312. Second transition portion 308 has a first lower corner 311 and an upper corner 313. It will be seen that corner 313 is the uppermost point of second transition portion 308.

As seen in FIG. 6, ball bearing 292 is initially in the lower end of first vertical portion 298.

Referring again to FIG. 3E, the lower end of lower disabling mandrel 256 is attached to a mandrel adapter 314 at threaded connection 316. A sealing means, such as O-ring 318, provides sealing engagement between mandrel adapter 314 and lower disabling mandrel 256.

Mandrel adapter 314 is connected to an overshot adapter 320 at threaded connection 322, with a sealing means, such as O-ring 324, providing sealing engagement therebetween. Overshot adapter 320 defines a bore 326 therethrough.

Overshot adapter 320 is the upper component of an overshot assembly 328. Overshot assembly 328 also includes an overshot sleeve 330 attached to the lower end of overshot adapter 320 at threaded connection 332.

Figure 3F:
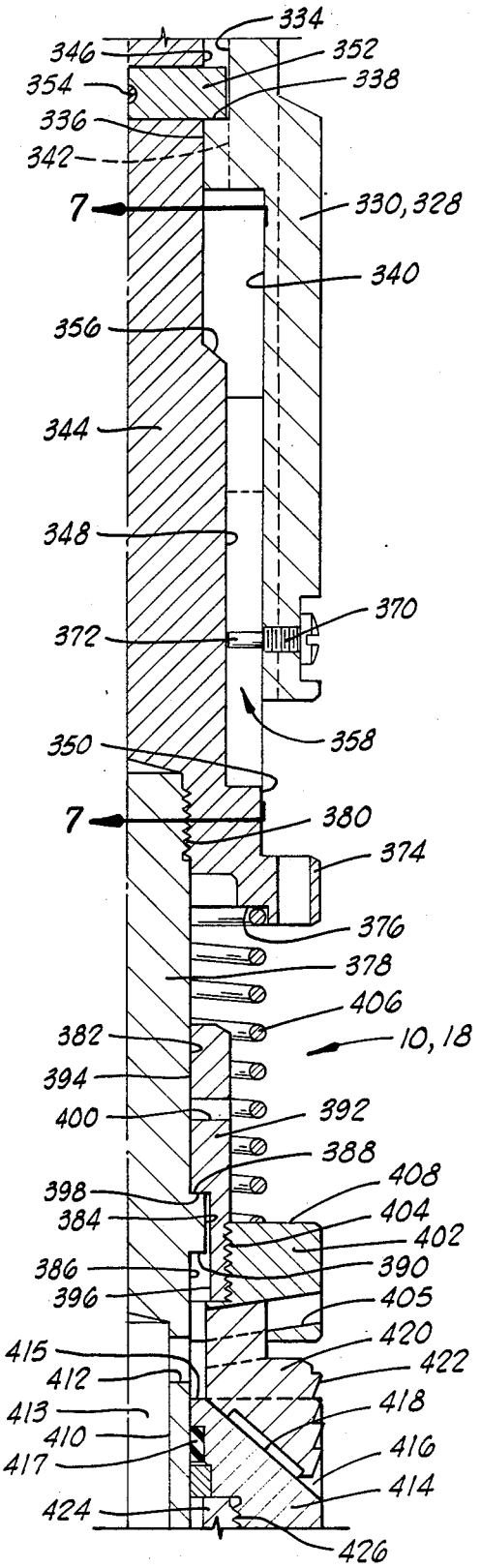

Referring to FIGS. 3E and 3F, overshot sleeve 330 defines a first bore 334 and a smaller second bore 336 therein such that an upwardly facing shoulder 338 is formed. A larger third bore 340 is defined in overshot sleeve 330 below second bore 336. A transversely extending keyway 342 is cut into second bore 336 as shown in FIG. 3F. The radially outer surface of keyway 342 is substantially aligned with first bore 334.

Plug means 18 is represented in the drawings by a retrievable bridge plug 18. As already indicated, bridge plug 18 is substantially similar to Halliburton Model 3L bridge plug, except that bridge plug 18 is designed to be set with right-hand torque rather than left-hand torque.

The upper component of bridge plug 18 is a retrieving head 344 with first, second and third outside diameters 346, 348 and 350 thereon. Retrieving head 344 is initially positioned within overshot assembly 328 such that the upper end of first outside diameter 346 is in close spaced relationship to bore 326 in overshot adapter 320 as seen in FIG. 3E. Also, as seen in FIG. 3F, first outside diameter 346 is in close spaced relationship to second bore 336 in overshot sleeve 330. A lug or key 352 is disposed transversely through retrieving head 344 and held in place by a fastener 354. In the initial position shown in FIG. 3F, key 352 rests on shoulder 338 in overshot sleeve 330. Key 352 is dimensioned to fit through slot 342 when aligned therewith so that bridge plug 18 may be disconnected from the rest of the tool as will be discussed further herein.

Referring again to FIG. 3F, an upwardly facing, chamfered shoulder 356 extends between first outside diameter 346 and second outside diameter 348 on retrieving head 344.

Figure 7:
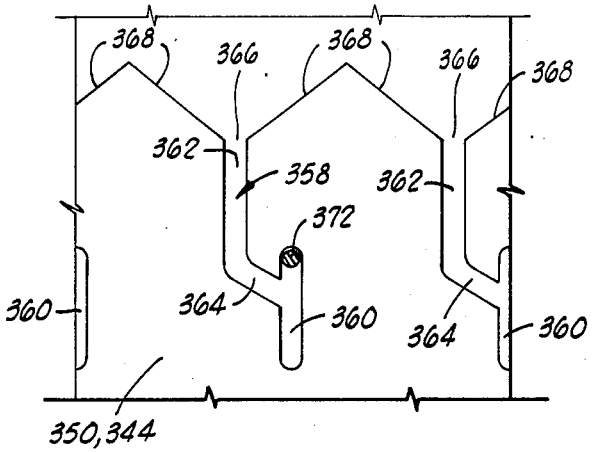
FIG. 7 presents a J-slot view taken along lines 7—7 in FIG. 3F.

Referring now also to FIG. 7, a recurring J-slot pattern 358 is formed in third outside diameter 350 of retrieving head 344. J-slot 358 has a first vertical portion 360 and a second vertical portion 362 interconnected by a transition portion 364. Second vertical portion 362 opens upwardly into an entry/exit portion 366 bounded in part by tapered walls 368.

A screw 370 is connected transversely in the lower end of overshot 330 and has a J-slot pin portion 372 which extends into J-slot 358. As shown in FIG. 7, pin 372 is in the upper end of first vertical portion 360 of J-slot 358 as tool 10 is lowered into the well bore.

The lower end of retrieving head 344 has a radially outwardly extending flange portion 374 and has a downwardly facing spring seat surface 376 thereon.

Retrieving head 344 is connected to a plug center mandrel 378 at threaded connection 380. Plug center mandrel 378 has a first outside diameter 382, a larger second outside diameter 384 and a third outside diameter 386 which is generally the same size as first outside diameter 382. It will thus be seen that an upwardly facing shoulder 388 extends between first and second outside diameters 382 and 384, and a downwardly facing shoulder 390 extends between second and third outside diameters 384 and 386 on plug center mandrel 378.

Disposed around plug center mandrel 378 is a spring centralizer 392 having first and second bores 394 and 396 therein. A downwardly facing shoulder 398 thus extends between first and second bores 394 and 396, and as seen in FIG. 3F, shoulder 398 engages shoulder 388 on plug center mandrel 378 as tool 10 is run into the well bore. Spring centralizer 392 defines a transverse hole 400 therethrough.

The lower end of spring centralizer 392 is connected to an upper slip retainer 402 at threaded connection 404. Upper slip retainer 402 defines a plurality of slots 405 therein.

A spring 406 is disposed around the upper end of plug center mandrel 378 and spring centralizer 392 and is located longitudinally between spring seat surface 376 on retrieving head 344 and upper surface 408 of upper slip retainer 402.

Plug center mandrel 378 has a bore 410 therein with a transverse bypass port 412 in communication therewith. Bore 410 forms part of a central opening 413 in plug means 18. In the initial position shown in FIG. 3F, port 412 is in communication with bypass port 405 in upper slip retainer 402.

Disposed below upper slip retainer 402 and around plug center mandrel 378 is an upper slip body 414. Upper slip body 414 has an upwardly facing shoulder 415 therein which generally faces shoulder 390 on plug center mandrel 378. A sealing means, such as bypass seal 417, provides sealing engagement between upper slip body 414 and third outside diameter 386 of plug center mandrel 378.

Upper slip body 414 also defines a plurality of wedge-shaped recesses 416 having an upwardly facing wedge-shaped ramp 418 therein. A slip 420 is disposed in each recess 416 and adapted to slide along ramp 418 in a manner known in the art. Slips 420 are also engaged with slots 405 in upper slip retainer 402. A plurality of teeth 422 are formed on the outer surface of each slip 420 and are adapted for grippingly engaging well casing 12. Slips 420 are loosely held in place by upper slip retainer 402.

Figure 3G:
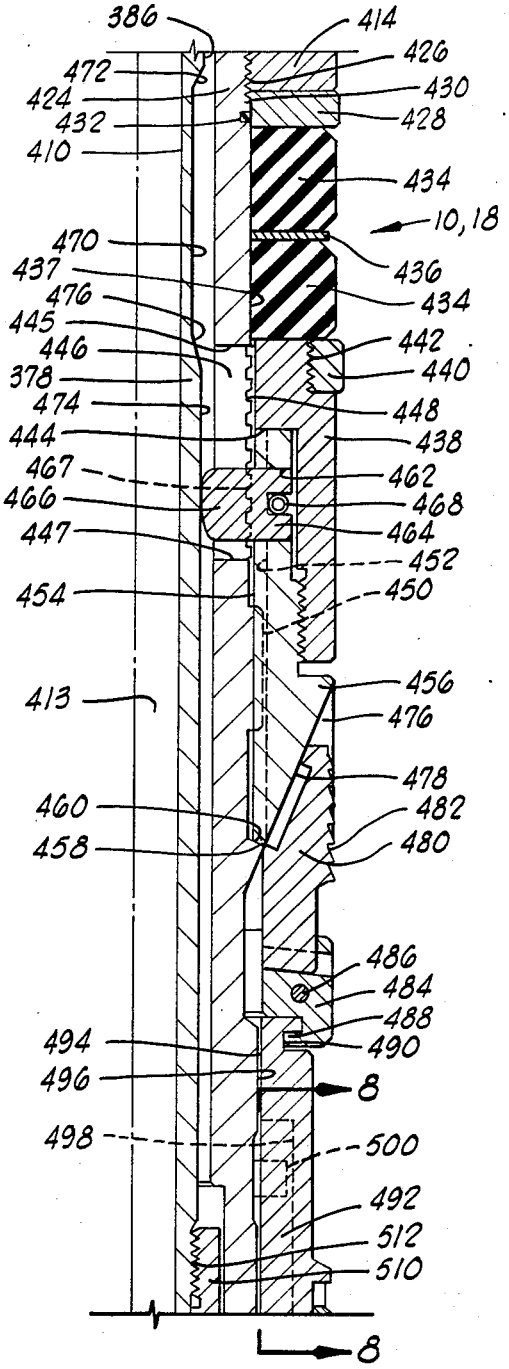

Referring now also to FIG. 3G, upper slip body 414 is attached to plug mandrel 424 at threaded connection 426.

Disposed below upper slip body 414 is an upper plug shoe 428. Upper plug shoe 428 is attached to plug mandrel 424 at threaded connection 430, and a sealing means, such as O-ring 432, provides sealing engagement therebetween.

Immediately below upper plug shoe 428 are a pair of elastomeric plug elements 434 separated by a divider ring 436. Plug elements 434 sealingly engage outside diameter 437 of plug mandrel 424.

Below plug elements 434 is a lower shoe support or ratchet cover 438 to which is attached a lower plug shoe 440 at threaded connection 442. Ratchet cover 438 has a downwardly facing shoulder 444 therein.

Plug mandrel 442 defines a plurality of longitudinally extending slots 446 therein, each slot having an upper end 445 and a lower end 447, and the outer surface of plug mandrel 424 along slots 446 defines an external ratchet surface 448 thereon.

Below slots 446, a lug 450 extends radially outwardly from plug mandrel 424. Lug 450 engages a longitudinal slot 452 in bore 454 of a lower slip body 456 so that relative rotation between plug mandrel 424 and lower slip body 456 is prevented. A lower end 458 of lower slip body 456 initially engages an upwardly facing chamfered shoulder 460 on plug mandrel 424 as seen in FIG. 3G.

Lower slip body 456 defines a plurality of transversely oriented windows 462 therethrough which are substantially aligned with slots 446 in plug mandrel 424. Positioned in each window 462 is a collar segment 464, and it will be seen that windows 462 restrain collar segments 464 from relative vertical movement with respect to lower slip body 456. Each collar segment 464 has a tang 466 which extends into a corresponding slot 446 in plug mandrel 424. A radially inward surface of each collar segment 464 defines a ratchet surface 467 thereon. As will be further discussed herein, ratchet 467 is adapted for engagement with ratchet surface 448 on plug mandrel 424 after setting of plug means 18. Collar segments 464 are biased radially inwardly by a resilient band 468.

Plug center mandrel 378 has a fourth outside diameter 470 which is smaller than third outside diameter 386 thereof with a downwardly facing chamfered shoulder 472 extending therebetween. Plug center mandrel 378 also has a fifth outside diameter 474 which is larger than fourth outside diameter 470 with an upwardly facing chamfered shoulder 476 extending therebetween. As seen in the initial position of FIG. 3G, resilient band 468 biases collar segments 464 radially inwardly such that tangs 466 of the collar segments engage fifth outside diameter 474 of plug center mandrel 378.

Lower slip body 456 defines a plurality of wedge-shaped recesses 476 having a downwardly facing wedge-shaped ramp 478 therein. A slip 480 is disposed in each recess 476 and adapted to slide along ramp 478 in a manner known in the art when actuated. A plurality of teeth 482 are formed on the outer surface of each slip 480 for grippingly engaging well casing 12. Slips 480 are loosely retained in place by a slip collar 484 which is held in position by a fastener 486.

Slip collar 484 has an inwardly directed flange which engages a groove 490 in the upper end of a drag block sleeve 492.

Figure 8:
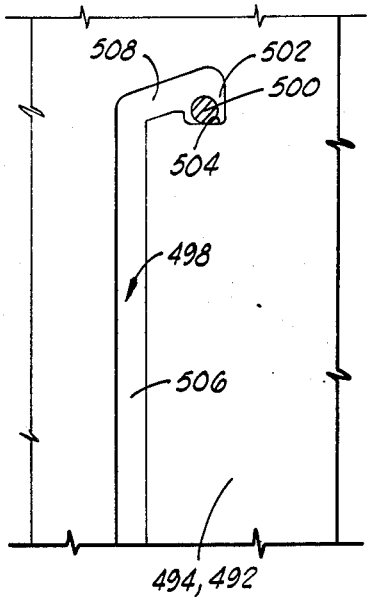
FIG. 8 shows a J-slot view taken along lines 8—8 in FIG. 3G.

Drag block sleeve 492 has a bore 494 therein adapted to slidably receive a second outside diameter 496 of plug mandrel 424. Referring also to FIG. 8, a J-slot 498 is defined in bore 494 of drag block sleeve 492. A lug 500 extends radially outwardly from plug mandrel 424 into and engaging J-slot 498. J-slot 498 has a short leg 502 having a lower end 504 and a longer downwardly extending leg 506 interconnected by a transition portion 508.

Figure 3H:
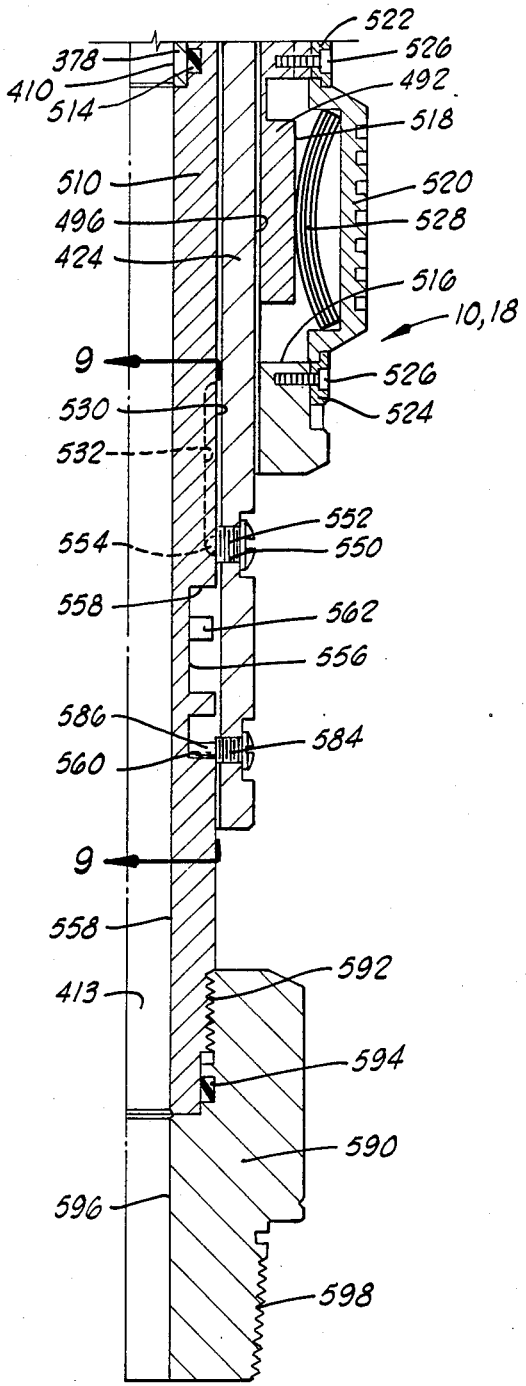

Still referring to FIG. 3G, the lower end of plug center mandrel 378 is attached to lower plug mandrel 510 at threaded connection 512. Referring now to FIG. 3H, a sealing means, such as O-ring 514, provides sealing engagement between lower plug mandrel 510 and plug center mandrel 378.

Still referring to FIG. 3H, drag block sleeve 492 defines a plurality of transverse drag block openings 516 therein below J-slot 498. A cylindrical portion 518 is aligned with openings 516 and faces radially outwardly. Disposed in each drag block opening 516 is a drag block 520. Each drag block 520 is retained in the corresponding drag block opening 516 by upper and lower drag block retainers 522 and 524 which are attached to drag block sleeve 492 by screws 526. A drag block spring 528 bears against cylindrical portion 518 of upper drag block sleeve 492 and biases the corresponding drag block 520 radially outwardly as shown in FIG. 3H.

Figure 9:
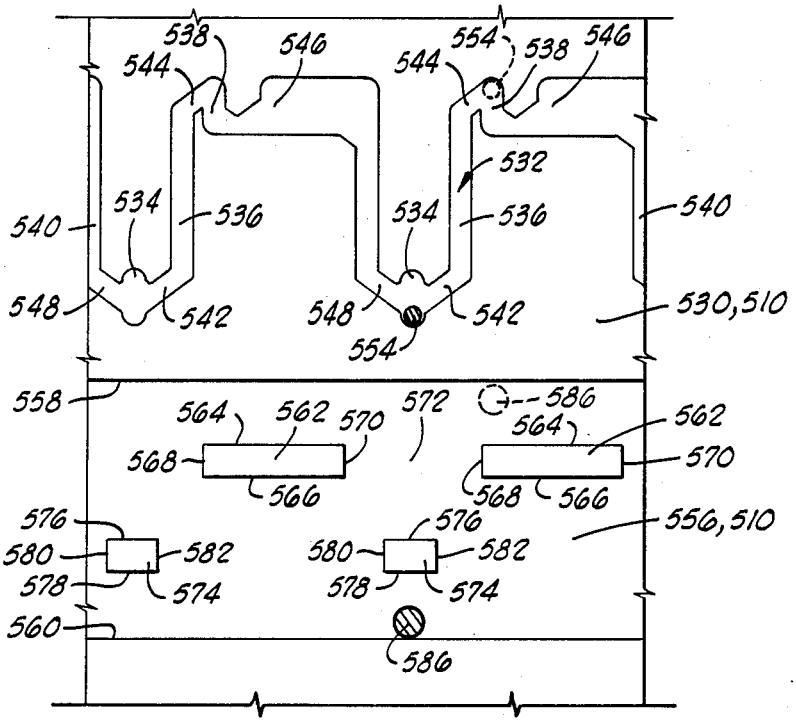
FIG. 9 illustrates a J-slot and lug view taken along lines 9—9 in FIG. 3H.

Referring now also to FIG. 9, outer surface 530 of lower plug mandrel 510 defines a recurring J-slot pattern 532 therein. J-slot 532 has a first vertical portion 534, a second vertical portion 536, a third vertical portion 538 and a fourth vertical portion 540. A first transition portion 542 interconnects first and second vertical portions 534 and 536. A second transition portion 544 interconnects second and third vertical portions 536 and 538. A third transition portion 546 interconnects third vertical portion 538 and fourth vertical portion 540. Finally, a fourth transition portion interconnects fourth vertical portion 540 and first vertical 534.

Below drag block sleeve 492, plug mandrel 424 has a threaded opening 550 therein. A bearing retainer 552 is threadingly engaged with opening 550 and locates and retains a ball bearing 554 which is rollingly received in J-slot 532 in outer surface 530 of lower plug mandrel 510. Actually, a plurality of ball bearings 554 may be used, but for the purposes of this disclosure, only one ball bearing is shown and discussed. As seen in FIG. 9, ball bearing 554 is initially positioned at the lower end of first vertical portion 534 of J-slot 532.

Still referring to FIGS. 3H and 9, a lug recess 556 is formed in outer surface 530 of lower plug mandrel 510. At the upper end of recess 556 is a downwardly facing shoulder 558, and at the lower end of recess 556 is an upwardly facing shoulder 560. A plurality of relatively long upper lugs 562 are spaced around recess 556. Each lug 562 has upper and lower surfaces 564 and 566 and opposite ends 568 and 570. It will be seen that a gap 572 is defined between adjacent lugs 562.

Disposed below upper lugs 562 are a plurality of relatively shorter lower lugs 574. Lugs 574 are generally centrally aligned with gaps 572 between lugs 562. Each lower lug 574 has upper and lower surfaces 576 and 578 and opposite ends 580 and 582.

Referring again to FIG. 3H, a screw 584 is disposed through the lower end of plug mandrel 424 and has a pin portion 586 which extends into lug recess 556 in outer surface 530 of lower plug mandrel 510. As seen in FIG. 9, pin 586 is initially disposed below a lower lug 574 in recess 556. As will be further discussed herein, the horizontal spacing between an end 582 of a lug 574 and an end 568 of a lug 562 is such that pin 586 may pass vertically therebetween. The spacing between an end 580 of a lower lug 574 and an end 570 of an upper lug 562 is the same.

Referring again to FIG. 3H, lower plug mandrel 510 defines a bore 558 therethrough which is in communication with and aligned with bore 510 in plug center mandrel 378. The lower end of lower plug mandrel 510 is connected to a lower adapter 590 at threaded connection 592. A sealing means, such as O-ring 594, provides sealing engagement between lower plug mandrel 510 and lower adapter 590. Lower plug mandrel 590 has a bore 596 therethrough which is in communication and aligned with bore 558 in lower plug mandrel 510. The lower end of lower adapter 590 has an externally threaded portion 598 which is adapted for connection, as desired, to additional tool string portions below tool 10.

OPERATION OF THE INVENTION

Referring to FIG. 1, retrievable bridge plug and packer tool 10 of the present invention is lowered into well casing 12 on tool string 28. Tool 10 is positioned such that plug means 18 is located below formation 14. As tool 10 is run into well casing 12, fluid will flow upwardly through central opening 413 in plug means 18 and bypasses plug elements 434 through bypass ports 412 in plug center mandrel 378 and around slips 420 as is known in the art. Also, fluid will be bypassed around packer elements 168 as hereinbefore described.

The weight of the various components of apparatus 10 hanging from tool string 28 and the friction of drag blocks 226, 276 and 520 on well casing 12 results in the following component positions. In packer means 16, lug 214 is at the bottom of short leg 216 of J-slot 12 as seen in FIG. 4; in disabling means 20, upper disabling teeth 236 are engaged with lower disabling teeth 240 as seen in FIG. 5; in disabling means 20, ball bearing 292 is at the bottom of first vertical portion 298 of J-slot groove 294 as seen in FIG. 6; in overshot assembly 328, pin 372 is at the top of first vertical portion 360 of J-slot 358 as seen in FIG. 7; and in plug means 18, lug 500 is at the bottom of short leg 502 of J-slot 498 as seen in FIG. 8 which results in ball bearing 554 being at the bottom of first vertical portion 534 of J-slot groove 532 and pin 586 being adjacent to shoulder 56 at the bottom of lug recess 556 and aligned with one of lower lugs 574 as seen in FIG. 9.

In this initial position, because upper disabling teeth 236 are engaged with lower disabling teeth 240, all of the components of packer means 16 are prevented from relative rotation from one another because of the engagement of pin 254 extending from lower disabling sleeve 242 with slot 250 in upper disabling mandrel 204. In other words, rotation of tool string 28 results in rotation of all of the components of packer means 16 so that the packer cannot be set accidentally at this point in the operation of apparatus 10.

However, plug means 18 can be set, and this setting is the next step in the operation. Drag blocks 520 are biased outwardly against well casing 12 by springs 528 so that picking up weight on tool string 18, applying right-hand torque thereto and setting down weight will cause lug 500 to move upwardly in short leg 502 of J-slot 498, through transition portion 508, and then into and downwardly through long leg 506 of J-slot 498. Drag block sleeve 492 is held relatively stationary by drag blocks 520 with respect to plug mandrel 424 at least until lug 500 contacts the upper end of short leg 502 of J-slot 498.

During this movement of lug 500 in J-slot 498, it will be seen that ball bearing 554 is moved in J-slot 532, again due to the setting down of weight and right-hand torque, from the bottom of first vertical portion 534 of J-slot 532, through transition portion 542 upwardly through second vertical portion 536, through second transition portion 544 and to a position at the top of third vertical portion 538. Simultaneously, pin 586 is moved in lug recess 556 upwardly and to the right in FIG. 9 such that pin 586 moves upwardly past end 582 of lower lug 574 and end 568 of upper lug 562 until it is adjacent to shoulder 558 in lug recess 556. The right-hand torque positions pin 586 above upper lug 562 toward the left end thereof, as indicated by the dashed lines in FIG. 9.

Again noting that drag blocks 520 hold drag block sleeve 492 substantially stationary during this movement, it will be seen that lower slip body 456 is moved downwardly with respect to lower slips 480 which forces the slips outwardly to grippingly engage well casing 12 to prevent any further downward movement of slips 480 and drag block sleeve 492.

As drill string 28 continues its downward travel, plug center mandrel 378 is likewise moved longitudinally downwardly with respect to the now-anchored portion of plug means 18. Referring to FIG. 3F, shoulder 388 on center plug mandrel 378 is moved downwardly away from shoulder 398 in spring centralizer 392. This action permits the compressive force in spring 406 to move upper slip retainer 402 downwardly, thus forcing upper slip 420 outwardly from upper slip body 414 to grippingly engage well casing 12 which prevents upward movement of plug means 18.

Also during this downward movement, bypass ports 412 in center plug mandrel 378 are moved downwardly past seal 417, thus closing the fluid bypass in plug means 18. Shoulder 390 on plug center mandrel 378 engages shoulder 415 on upper slip body 414, and the downward force compresses plug elements 434 into sealing engagement with well casing 12. Also during this movement, lug 450 on plug mandrel 424 moves downwardly through slot 452 in lower slip body 456, and collar segments 464 move relatively upwardly with respect to slot 446 in plug mandrel 424.

Further, during the downward movement of plug center mandrel 378, the narrowed portion thereof defined by fourth outside diameter 470 is moved downwardly to the level of collar segments 464. Since collar segments 464 are biased radially inwardly by resilient band 468, each of collar segments 464 "rides" on its respective tangs 466 down shoulder 468 to engage fourth outside diameter 470. This results in ratchet surface 467 in each collar segment 464 engaging ratchet surface 448 on plug mandrel 424. Such engagement prevents any upward movement of plug mandrel 424 since collar segments 464 are restrained from vertical movement in their respective windows 462 in lower slip body 456. The ratchet action does, however, permit downward movement of plug mandrel 424 and such continues until plug elements 434 completely seal well casing 12.

Additionally, during the setting of plug means 18 hereinbefore described, pin 372 extending from overshot sleeve 330 is moved downwardly in J-slot 358 to the bottom of first vertical portion 360 thereof. The upwardly sloping arrangement of transition portion 364 of J-slot 358 in combination with the setting down of weight, prevents pin 372 from moving into second vertical portion 362 of J-slot 358 at this point in the operation. Thus, overshot assembly 328 is still engaged with plug means 18.

During the setting of plug means 18 by this vertical manipulation of tool string 28 and right-hand torque, ball bearing 292 in disabling means 20 is moved relatively upwardly with respect to J-slot 294 through first vertical portion 298 thereof, and into first transition portion 306 thereof until it reaches the top of the first transition portion. During this movement, also, lug 214 in packer means 16 moves upwardly in short leg 216 of J-slot 212 in upper drag block sleeve 202, but rotational movement is prevented by the engagement of disabling teeth 236 and 238 in disabling means 20, as already described.

After setting plug means 18, weight may be picked up on tool string 28 without any torque. When this occurs, pin 372 in overshot assembly 328 is again moved upwardly to the top of first vertical portion 360 of J-slot 358 so that an upward pull may be applied to plug means 18 to check the setting thereof.

Weight is once again set down, and then by once again picking up weight on tool string 28 and applying right-hand torque, pin 372 in overshot assembly 328 will move upwardly through first vertical portion 360 into transition portion 364 and then into second vertical portion 368 of J-slot 358. As overshot assembly 328 rotates, keyway 342 in overshot sleeve 330 will be aligned with key 352 on retrieving head 344. At this point, overshot assembly 328 is released from the set plug means 18 and may be moved upwardly therefrom by lifting on tool string 28.

During this lifting and right-hand torque which releases the upper components of apparatus 10 from plug means 18, ball bearing 292 mounted on lower drag sleeve 260 in disabling means 20 will move from transition portion 306 of J-slot 294 into second vertical portion 300 thereof. The upward pull on tool string 28 will then be seen to cause ball bearing 292 to be moved to the bottom of first vertical portion 300 and into second transition portion 308 at corner 311 as indicated by the dashed lines in FIG. 6. In other words, lower drag block sleeve 260 remains relatively stationary due to the engagement of drag blocks 276 with well casing 12, and upper disabling mandrel 204 and lower disabling mandrel 256 move upwardly with respect thereto. Thus, slot 250 in upper disabling mandrel 204 moves upwardly with respect to pin 254. Because lug 214 engages the upper end of short leg 216 of J-slot 212 in upper drag block sleeve 202, upper drag block sleeve 202 is moved upwardly with respect to lower drag block sleeve 260. The result of this movement is that upper disabling teeth 236 are disengaged from lower disabling teeth 238 as shown in FIG. 2. Thus, disabling teeth 236 and 238 are relatively moved from a first, packer disabling position to a second, packer set position. At this point, packer means 16 is no longer disabled and may be set at the desired position within well casing 12 above formation 14.

Once packer means 16 has been located as desired, weight is once again set down on tool string 28 and right-hand torque applied. Because drag blocks 226 in upper drag block sleeve 202 engage well casing 12, upper drag block sleeve 202 will remain relatively stationary with respect to the remainder of packer means 12. During the setting down of weight and right-hand rotation, plug 214 will move upwardly in short leg 216 of J-slot 212 and then pass through transition portion 221 into long leg 220 of J-slot 212.

The downward movement results in shoulder 42 on upper packer mandrel 30 being moved downwardly from shoulder 73 in hydraulic slip housing 50 until shoulder 43 on the upper packer mandrel contacts the upper end of coupling 46, forcing the coupling downwardly with respect to hydraulic slip housing 50 which also causes inner sleeve 106 to move downwardly with respect to outer sleeve 124. This downward movement in turn causes bypass ports 118 to be closed because they are moved below seals 126. Shoulder 121 contacts the upper end of outer sleeve 124, and it will be seen that further downward movement of tool string 28 will cause slip body 174 to move downwardly with respect to slips 188, thus forcing the slips outwardly to grippingly engage well casing 12. This engagement prevents further downward movement of slips 188 and the components attached thereto. As is known in the art, packer elements 168 will be compressed to sealingly engage well casing 12.

At this point, packer means 16 is set above well formation 14, and treatment of the well formation may be carried out. Pressure applied through tubing string 28 through packer means 16, and thus through disabling means 20, to well formation 14 will result in pressure being applied to hydraulic slips 62 through port 197 in slip body 174, annular volume 183, annular volume 143, annular volume 135, annular gap 116, annular volume 80, passageway 84, annular gap 74 and annular gap 60. This pressure moves hydraulic slips 62 outwardly to grippingly engage well casing 12. Thus, upward movement of packer means 16 is prevented in a manner known in the art.

During the setting of packer means 16, ball bearing 292 will be moved upwardly to uppermost corner 313 in transition portion 308 of J-slot 294.

Once the treatment is carried out, the entire tool 10 may be retrieved. The first step in retrieval is to pick up weight on tool string 28 without torque. This will once again bring shoulder 42 on upper packer mandrel 30 into engagement with shoulder 73 in hydraulic slip housing 50. The upward pull will relieve the compression on packer elements 168 so that they disengage from well casing 12 and will also move slip body 174 upwardly with respect to slips 188. Teeth 190 on slips 188 will become disengaged from well casing 12.

As will be seen by those skilled in the art, this upward movement to unset packer means 16 will cause lug 214 on upper disabling mandrel 204 to move upwardly in longer leg 220 of J-slot 212 and then be guided through tapered transition portion 221 to the upper end of short leg 216 of the J-slot.

As packer means 16 is unset, ball bearing 292 is moved through transition portion 308 to the bottom of third vertical portion 302 of J-slot groove 294.

Weight is again set down on tool string 28. This causes lug 214 to move to lower end 218 of short leg 216 of J-slot 212, and it also causes ball bearing 292 to be moved relatively upwardly within third vertical portion 302 of J-slot groove 294, through third transition portion 310 to the upper end of fourth vertical portion 304 of J-slot groove 294. Simultaneously, it will be seen that upper disabling teeth 236 are re-engaged with lower disabling teeth 240. Tapered ends 246 of upper disabling teeth 236 and corresponding tapered ends 248 of lower disabling teeth 240 insure that the disabling teeth are guided to their engaged positions.

Further downward movement of tool string 28 will thus be seen to move both packer means 16 and disabling means 20 such that overshot assembly 328 will be positioned to reengage retrieving head 344 on plug means 18. Pin 372 in overshot assembly 328 will be moved into entry portion 366 of J-slot 358 and guided by tapered walls 368 into second vertical portion 362 of J-slot 358. Pin 372 will then move downwardly through second vertical portion 362 and guided into first vertical portion 360 by transition portion 364. A slight amount of right-hand torque on tool string 28 may be necessary to bring keyway 342 in overshot sleeve 330 into alignment with key 352 so that overshot assembly 328 will be moved to its downwardmost position with pin 372 at the bottom of first vertical portion 360 of J-slot 358.

Tool string 28 is then picked up without rotation which moves pin 372 to the upper end of first vertical portion 360 of J-slot 358, and it will be seen that a lifting force is thus applied to retrieving head 344, plug center mandrel 378 and lower plug mandrel 510.

This upward movement brings shoulder 388 on plug center mandrel 378 into engagement with shoulder 398 in spring centralizer 392 which pulls upwardly on upper slips 420 in plug means 18 to disengage these upper slips from well casing 12. This relieves the compression on plug elements 434 so that they also disengage from well casing 12.

Also during this upward movement, fifth outside diameter 474 of plug center mandrel 378 is re-engaged with tangs 466 of collar elements 464, forcing the collar elements radially outwardly such that ratchet surface 467 in collar elements 464 is disengaged from ratchet surface 448 on plug mandrel 424.

Further upward movement brings shoulder 460 on plug mandrel 424 into engagement with end 458 of lower slip body 456, pulling the lower slip body away from lower slips 480 so that the lower slips are disengaged from well casing 12.

During this upward movement to unset plug means 18, lug 500 is moved upwardly through long leg 506 of J-slot 498, through transition portion 508 and into the upper end of short leg 502 of J-slot 498. Also during this upward movement, it will be seen that ball bearing 554 is repositioned to the lower end of third vertical portion 538 of J-slot 532 at the lower end of plug means 18, and pin 586 is moved downwardly to engage upper surface 564 of upper lug 562 in lug recess 556. This latter engagement prevents excess loading on ball bearing 554 in J-slot 532. At this point, a little right-hand torque is applied to tool string 28 with weight still being set down. Pin 586 will move along upper surface 564 of upper lug 562, and ball bearing 554 will be moved through third transition portion 546 of J-slot 532. Once pin 586 passes end 570 of upper lug 562, pin 586 is free to move downwardly to re-engage shoulder 560 in lug recess 556. Ball bearing 554 moves correspondingly downwardly through fourth vertical portion 540 of J-slot 532 and is guided back to the bottom of first vertical portion 534 by fourth transition portion 548 of J-slot 532.

It will be seen that apparatus 10 is thus returned to its original position and configuration as shown in FIGS. 1 and 3–9. Retrievable bridge plug and packer apparatus 10 may be repositioned at any other desired location in the well bore and reoperated as hereinbefore described. Alternatively, apparatus 10 may be removed from the well bore and reused at a later time.

The path in J-slot 294 in disabling means 20 from fourth vertical portion 304 to first vertical portion 298 through fourth transition portion 312 is an extra path which allows for some vertical movement and rotation of tool 10 if sand is clogging retrieving neck 344 of plug means 18. In this way, an extra manipulation of tool string 28 is possible without actuating disengaging means 20 to the packer set position prematurely.

It will be seen, therefore, that the retrievable bridge plug and packer apparatus of the present invention is well adapted to carry out the ends and advantages mentioned, as well as those inherent therein. In particular, the invention is ideal for horizontal or deviated wells where lefthand rotation is undesirable. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. An apparatus for use in a well bore, said apparatus comprising:

plug means for sealingly engaging said well bore when in a set position;

plug setting means for setting said plug means by applying torque in one direction to a portion thereof;

packer means, disconnectable from said plug means, for sealingly engaging said well bore when in a set position at a location spaced from said plug means;

means for disconnecting said packer means from said plug means after setting of said plug means; and packer setting means for setting said packer means by applying torque in said one direction to a portion thereof.

2. The apparatus of claim 1 further comprising disabling means for disabling said packer setting means while said plug means is being set.

3. The apparatus of claim 2 wherein said disabling means comprises upper and lower engaging means for preventing relative rotation therebetween when in a packer disabling position, said upper and lower engaging means being spaced from one another when in a packer setting position.

4. The apparatus of claim 3 wherein:

said packer means comprises mandrel means for extending from said packer means and into said upper and lower engaging means; and further comprising means for preventing relative rotation between said mandrel means and said lower engaging means.

5. The apparatus of claim 4 wherein said means for preventing relative rotation comprises:

one of said mandrel means and said lower engaging means defining a slot thereon; and the other of said mandrel means and said lower engaging means having a pin extending therefrom and into said slot.

6. The apparatus of claim 3 wherein said packer means comprises mandrel means for extending from said packer means and into said upper and lower engaging means, and further comprising:

J-slot means on one of said mandrel means and lower engaging means; and

J-slot engaging means on the other of said mandrel means and lower engaging means for engaging said J-slot means;

whereby, said lower engaging means and said upper engaging means are relatively moved between said packer disabling position and said packer setting position.

7. The apparatus of claim 3 further comprising drag means on said upper and lower engaging means for frictionally engaging said well bore and holding said upper and lower engaging means relatively stationary with respect to said packer means during at least a portion of the operation of said apparatus.

8. A downhole tool comprising:

a packer attachable to a tool string and including packer setting means for setting said packer in a well bore;

a plug releasably connected to said packer and including plug setting means for setting said plug in said well bore;

means for disabling said packer setting means during setting of said plug and reengaging said packer setting means for subsequent setting of said packer, wherein said packer setting means is actuated at least in part in response to rotation of said tool string in a single direction and said plug setting means is actuated at least in part in response to rotation of said tool string in said single direction; and means for releasing said plug from said packer and said means for disabling.

9. The apparatus of claim 8 wherein said single direction is to the right when viewed from the top of said well bore.

10. A method of treating a well formation comprising the steps of:

positioning a tool on a tool string in a well bore, said tool comprising a bridge plug and a packer above said bridge plug;

setting said bridge plug into sealing engagement with said well bore below said formation by applying torque in a single direction to said tool string;

during said step of setting said bridge plug, disabling said packer so that the packer cannot be prematurely set;

after setting of said bridge plug, re-enabling said packer and disconnecting said packer from said bridge plug; and setting said packer into sealing engagement with said well bore above said bridge plug by applying torque to said tool string in the same direction used for setting said bridge plug.

11. The method of claim 10 further comprising the steps of:

unsetting said packer from said well bore;

re-connecting said packer to said bridge plug; and unsetting said bridge plug from said well bore.

12. An apparatus for use in a well bore, said apparatus comprising:

plug means for sealingly engaging said well bore when in a set position;

plug setting means for setting said plug means by applying torque in one direction to a portion thereof;

packer means for sealingly engaging said well bore when in a set portion at a location spaced from said plug means;

packer setting means for setting said packer means by applying torque in one direction to a portion thereof; and disabling means for disabling said packer setting means when said plug means is being set, said disabling means comprising upper and lower engaging means for preventing relative rotation therebetween when in a packer disabling position, said upper and lower engaging means being spaced from one another when in a packer setting position, and wherein:

said upper engaging means is characterized by an upper disabling sleeve connected to said packer means and having upper disabling teeth thereon; and said lower engaging means is characterized by a lower disabling sleeve connected to said packer means and having lower disabling teeth thereon engaged with said upper disabling teeth when in said packer disabling position and spaced from said upper disabling teeth when in said packer setting position.

13. A downhole tool comprising:

a packer attachable to a tool string and including packer setting means for setting said packer in a well bore;

a plug connected to said packer and including plug setting means for setting said plug in said well bore; and means for disabling said packer setting means during setting of said plug and re-engaging said packer setting means for subsequent setting of said packer, said means for disabling comprising:

a mandrel defining a slot therein, said mandrel being connected to said packer;

a first sleeve with downwardly extending teeth thereon;

a second sleeve with upwardly extending teeth thereon for engaging said downwardly extending teeth when in a first position such that relative rotation between said first and second sleeves is prevented and being relatively movable to a second position wherein said upwardly extending teeth are disengaged from said downwardly extending teeth; and a pin on said second sleeve and extending therefrom for engaging said slot in said mandrel for preventing relative rotation between said mandrel and said second sleeve.

14. The apparatus of claim 13 wherein said mandrel defines a J-slot therein; and further comprising J-slot engaging means on said second sleeve for engaging said J-slot, whereby said second sleeve is guided between said first and second positions.

15. The apparatus of claim 14 wherein:

said J-slot and J-slot engaging means hold said first and second sleeves in said engaged position during setting of said plug; and said J-slot and said J-slot engaging means hold said first and second sleeves in said disengaged position after setting of said plug.

16. The apparatus of claim 14 further comprising a drag block on said second sleeve for holding said second sleeve relatively stationary with respect to said mandrel.

* * * * *